United States Patent [19]

Otoshima

[11] Patent Number: 4,660,780

[45] Date of Patent: Apr. 28, 1987

[54] YARN END FINDING DEVICE

[75] Inventor: Hiroo Otoshima, Shiga, Japan

[73] Assignee: Murata Kikai Kabushiki Kaisha, Osaka, Japan

[21] Appl. No.: 719,377

[22] Filed: Apr. 3, 1985

[30] Foreign Application Priority Data

Apr. 5, 1984 [JP] Japan ..... 59-68672

[51] Int. Cl.[4] ..... B65H 67/08; B65H 54/22

[52] U.S. Cl. ..... 242/35.6 E; 30/133; 83/100; 83/411 R; 83/909

[58] Field of Search ..... 242/35.6 E, 35.6 R, 242/35.5 R, 18 R; 30/124, 133; 83/100, 402, 411 R, 909

[56] References Cited

U.S. PATENT DOCUMENTS

| | | | |
|---|---|---|---|
| 3,355,118 | 11/1967 | Kupper | 242/35.6 E |
| 3,373,948 | 3/1968 | Raasch | 242/35.6 E |
| 3,388,872 | 6/1968 | Kupper | 242/35.6 E |
| 3,406,920 | 10/1968 | Kamp | 242/35.6 E |
| 3,441,230 | 4/1969 | Kupper | 242/35.6 E |
| 3,608,843 | 9/1971 | Siedlich | 242/35.6 E |
| 4,036,444 | 7/1977 | Suter | 242/35.6 E |

*Primary Examiner*—Stanley N. Gilreath

*Attorney, Agent, or Firm*—Spensley Horn Jubas & Lubitz

[57] ABSTRACT

A device for finding an end of yarn from a spinning bobbin produced on a spinning frame. The yarn end finding device includes a suction case, a suction cutter drum in the form of a drum mounted for rotation in the suction case, and a cutter for cutting at a predetermined fixed position an end of a yarn sucked in through one of a number of holes formed in a circumferential face of the suction cutter drum.

13 Claims, 10 Drawing Figures

YARN END FINDING DEVICE

BACKGROUND OF THE INVENTION

1. Field of the Invention

This invention relates to a device for finding an end of yarn from a spinning bobbin produced on a spinning frame.

2. Prior Art

Normally, a spinning bobbin produced on a spinning frame, particularly on a ring spinning frame, has a so-called tail yarn winding in which an end of a yarn is wound by several turns around a tail or head portion of the spinning bobbin in order to prevent the yarn end from being released from the spinning bobbin or to prevent the yarn end from being entangled with a yarn end of another spinning bobbin while it is transported to a next rewinding step. Further, when a spinning bobbin having such a tail yarn thereon is to be supplied to a rewinding step, that is, to a winding unit of an automatic winder, it is fed to a yarn end finding device in order that the tail yarn may be released in advance to enable automatic splicing of yarns at the winding unit sufficiently before the spinning bobbin is positioned to a predetermined fixed position of a winding unit of the winder.

In such a yarn end finding device, when a tail yarn wound around a tail or head portion of a spinning bobbin is to be released or removed, it sometimes occurs that an end of a yarn from which winding onto a spinning bobbin has been started on a spinning frame, that is, a yarn end extending from an innermost layer of the yarn, becomes entangled with a tail yarn, resulting in difficulty to release the tail yarn, or where a reinforcing annular fixture is mounted on an end portion of a take-up tube of a spinning bobbin, a gap or clearance appears between the fixture and the take-up tube. Accordingly, a tail yarn sometimes enters the gap so that the tail yarn cannot possibly be released only by compressed air blown to the tail yarn or by placing in a suction air flow, resulting in failure in finding an end of a yarn.

SUMMARY OF THE INVENTION

An object of the present invention is to provide a yarn end finding device which can forcibly release and cut a twined tail yarn of a spinning bobbin and find an end of a yarn very certainly. A yarn end finding device of the invention is characterized by a suction case, a suction cutter drum device in the form of a drum mounted for rotation in the suction case, and a cutter for cutting at a predetermined fixed position an end of a yarn sucked in through one of a number of holes formed in a circumferential face of the suction cutter drum.

DETAILED DESCRIPTION OF THE INVENTION

An embodiment of the present invention will now be described with reference to the accompanying drawings.

Figure 1:
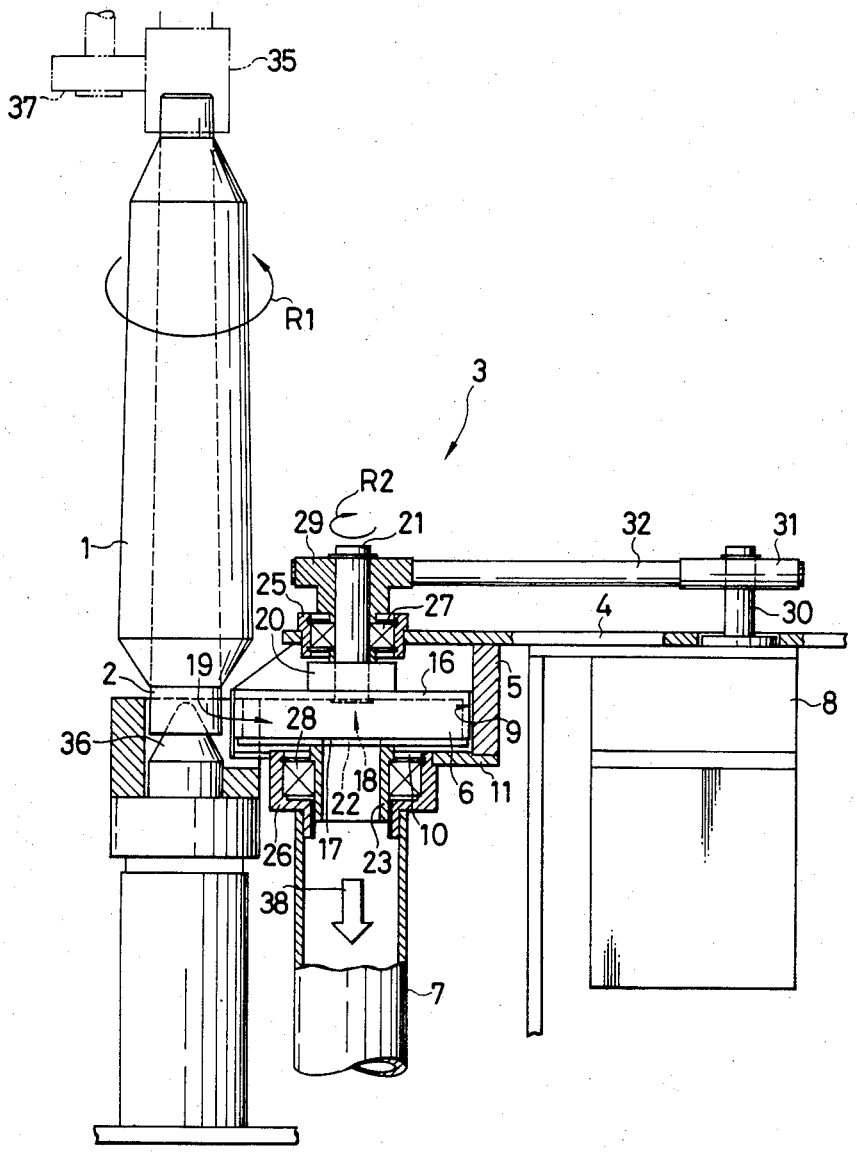
FIG. 1 is a cross sectional front elevational view illustrating an embodiment of yarn end finding device of the present invention.
Figure 2:
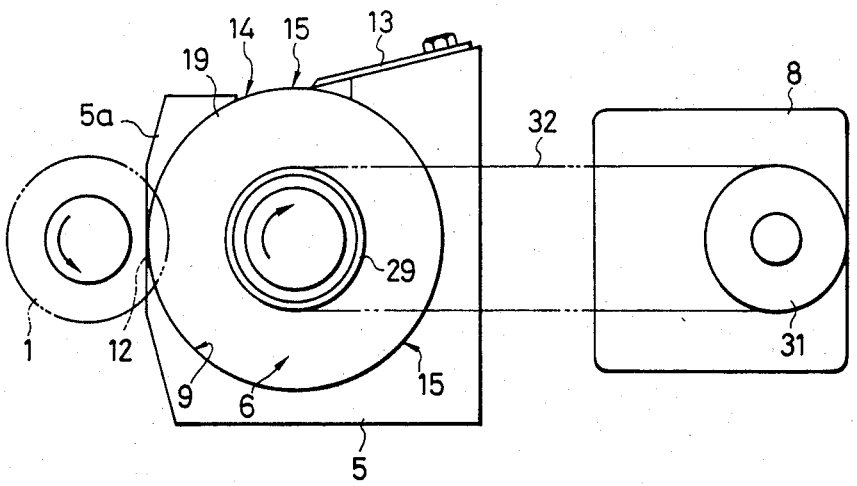
FIG. 2 is a plan view of the yarn end finding device of FIG. 1.

Reference is first had to FIGS. 1 and 2 to describe an example in which the invention is applied for releasing a tail yarn wound on a tail portion 2 of a spinning bobbin 1.

A yarn end finding device 3 is located at a position at which a tail yarn is to be released from a spinning bobbin 1 and includes a suction case 5 securely supported on a fixed frame 4 and a suction cutter drum device 6 mounted for rotation within the suction case 5. Located adjacent and connected to the yarn end finding device 3 are a suction pipe 7 for producing a suction air flow within an interior spacing of the suction cutter drum device 6, a motor 8 for driving the suction cutter drum device 6 to rotate. In particular, the suction case 5 supported on the frame 4 has an inner circumferential face 9 having substantially the same diameter with an outer circumferential face of the suction cutter drum device 6 in the form of a drum, and a bottom wall face 11 having a hole 10 formed to receive therein a hollow shaft of the suction cutter drum 6. A yarn end sucking hole 12 and a cut-out portion 14 for allowing an edge of a fixed blade 13 to contact with the outer circumferential face of the suction cutter drum device 6 are formed in spaced relationship in the inner circumferential face 9 of the suction case 5.

Meanwhile, the suction cutter drum device 6 accommodated in the suction case 5 includes a drum 19 having an inner spacing 18 defined by an outer circumferential face 15, a top face 16 and a bottom face 17 thereof, a shaft receiving member 20 integrally formed on the top face 16 of the drum 19, a shaft 21 extending through and secured to the shaft receiving member 20, an opening 22 formed in the bottom face 17 of the drum 19 for allowing a suction air flow to pass therethrough, and a pipe member 23 secured adjacent the opening 22.

Figure 3:
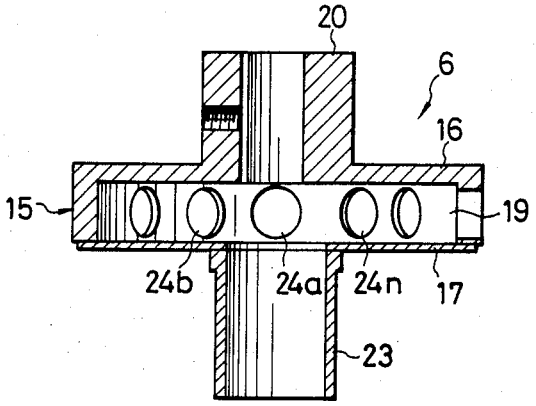
FIG. 3 is a cross sectional front elevational view of a suction cutter drum device.
Figure 4:
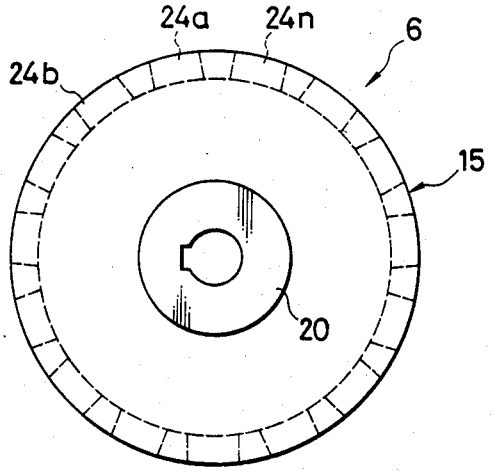
FIG. 4 is a plan view of the suction cutter drum device of FIG. 3.

As seen in FIGS. 3 and 4, a number of circular holes **24*a* to 24*n* are perforated substantially in equidistantly spaced relationship in the outer circumferential face 15 of the drum 19 of the suction cutter drum device 6, and thus a cutting means is formed by circumferential edges of the holes 24*a* to 24*n* and the cooperating fixed blade 13** as described hereinafter.

The suction cutter drum device 6 is supported for rotation on bearing portions 25 and 26 of the suction case 5 by means of bearings 27 and 28. A pulley 29 is secured to an end of the shaft 21, and a belt 32 extends between the pulley 29 and another pulley 31 fixedly mounted on a drive shaft 30 of the motor 8. The suction pipe 7 is connected to the pipe member 23 of the suction cutter drum device 6 and also to a blower via a change-over valve not shown.

Figure 5:
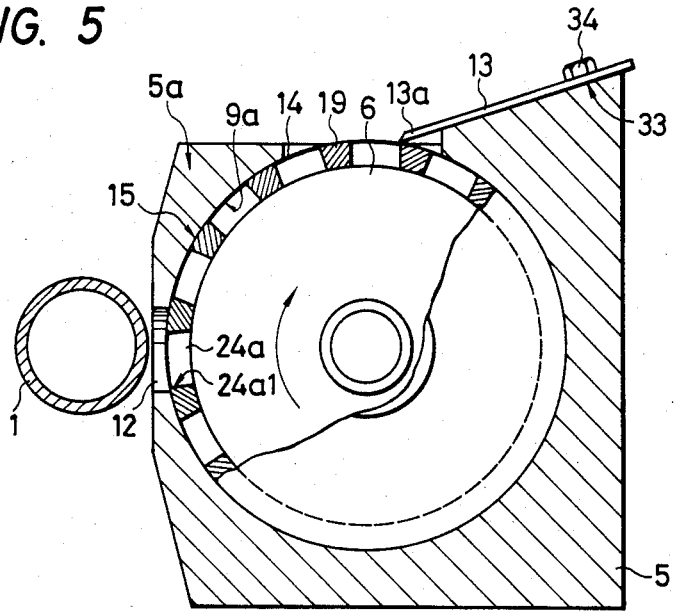
FIG. 5 is a cross sectional plan view illustrating relative positions of the suction case and the suction cutter drum device.
Figure 6:
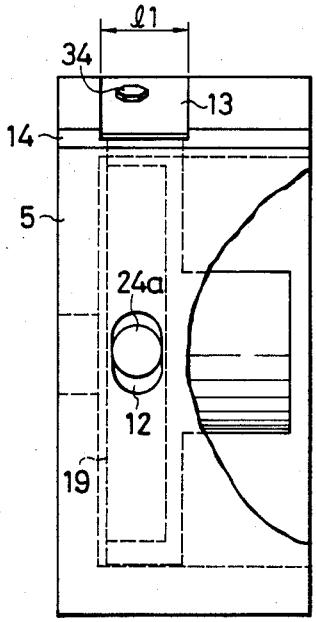
FIG. 6 is a side elevational view of the suction case and the suction cutter drum device.

FIGS. 5 and 6 illustrate relative positions of the suction cutter drum device 6 and the suction case 5. In particular, a small gap is formed between the inner circumferential face 9 of the suction case 5 and the outer circumferential face 15 of the drum 19 of the suction cutter drum device 6. The gap is positioned and dimensioned to allow a yarn released from a spinning bobbin to pass therethrough and is adapted to allow a yarn being sucked into the interior of the drum 19 through the hole 24*a* in the drum 19 to be fed from the hole 12 in the suction case 5 to the cut-out portion 14 at the cutter position. The gap may be adjusted in accordance with the thickness of a yarn to be handled by adjusting the most important portion 5*a* of the case 5 in a radial direction. The portion 5*a* of the case 5 is a portion 9*a* of an inner circumferential wall between the yarn end sucking hole 12 and the cut-out portion 14.

Meanwhile, the fixed blade 13 located adjacent the cut-out portion 14 in the case 5 is secured to an inclined face 33 of the case 5 by means of a screw 34 and is positioned such that an edge 13*a* thereof is in contact with the outer circumferential face 15 of the drum 19 to cut an end of a yarn being fed as the drum 19 rotates between the blade edge 13*a* and any of rear edge 24*a*1 to 24*n*1 of the holes 24*a* to 24*n* of the drum 19. The fixed blade 13 may have a width L1 greater than the diameter of the holes 24*a* to 24*n* of the drum 19 of the suction cutter drum device 6, and when worn, it may be replaced by another only by removing and fixing the screw 34.

Yarn end finding operations on the device as described above will now be described. Referring to FIG. 1, for example, in case a tail yarn is wound at the tail portion 2 of a spinning bobbin 1, the spinning bobbin 1 is positioned to a predetermined position with an upper end of a take-up tube thereof held by a chuck member 35. In such a case as illustrated in FIG. 1, if a lower end of the spinning bobbin 1 is fitted on a positioning rod 36, then the spinning bobbin will be positioned more accurately. A friction roller 37 is also provided which is located in contact with the chuck member 35 for rotating the spinning bobbin 1 in a direction of an arrow mark R1. A spinning bobbin could otherwise be rotated by a roller located in contact with a surface of a yarn layer of the spinning bobbin. It is to be noted that the arrow mark R1 indicates a direction to pick up or release an end of a yarn of a yarn layer.

Then, the motor 8 is rotated to rotate the suction cutter drum device 6 in a direction of an arrow mark R2 while the pipe body 7 is acted upon by a suction air flow in a direction of an arrow mark 38 so as to cause a sucking force in the interior spacing of the drum 19.

Figure 7:
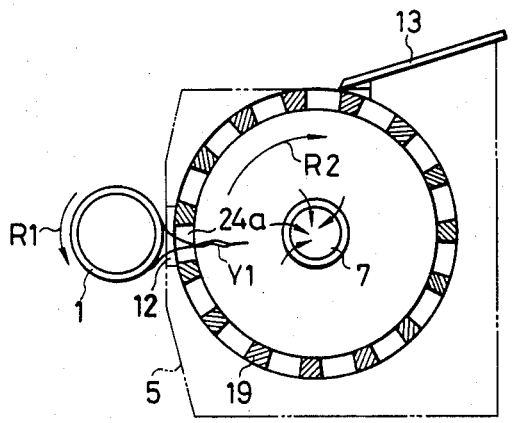
FIGS. 7 and 8 are cross sectional plan views illustrating a step of drawing out an end of a yarn.
Figure 8:
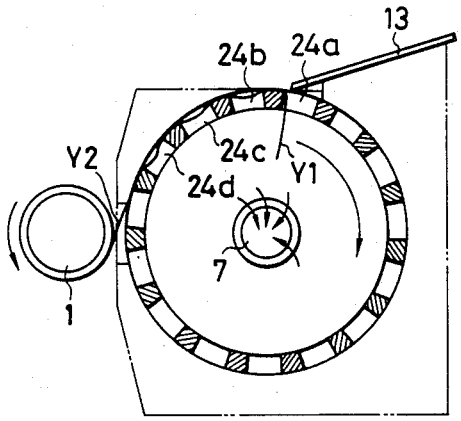

As a result, an end of a yarn coiling itself around a lower end portion of the spinning frame or an end Y1 of a yarn twined with a beginning end of the yarn on the spinning bobbin as seen in FIG. 7 will be sucked into the interior of the drum 19 through the hole 12 of the suction case 5 and the hole 24*a* of the circumferential face of the drum 19 by the sucking action of the drum 19 while the yarn end is picked up or released as the drum 19 is rotated in the direction of the arrow mark R2 and the spinning bobbin 1 is rotated in the direction of the arrow mark R1. Once the yarn end Y1 has been sucked into the interior of the drum 19, a yarn Y2 drawn out from the spinning bobbin is attracted to the circumferential face of the drum 19 and is fed in the gap between the inner circumferential face of the casing 5 and the outer circumferential face of the drum 19. Hence, the entangled yarn ends will be forcibly drawn out, and a yarn end put between a metal fixture at an end of the spinning bobbin and a take-up tube will also be drawn out forcibly. In particular, while the yarn end Y1 which has been sucked into the hole 24*a* of the drum 19 at the position of FIG. 7 is brought to a position as shown in FIG. 8 by the hole 24*a* of the drum 19 as the drum 19 rotates, the yarn drawn out from the spinning bobbin will be caused to form loops in succeeding holes 24*b*, 24*c* and 24*d* in the outer periphery of the drum 19 by sucking force of each of the holes 24*b*, 24*c* and 24*d* while it will be fed between the inner circumferential face 9*a* of the casing 9 and the outer circumferential face 15 of the drum 19. The yarn end Y1 sucked in the hole 24*a* is cut by a rear edge of the hole 24*a* and the fixed blade 13 as it passes the fixed blade 13, and the yarn end thus cut off is sucked into and discharged from the suction pipe 7. As the drum 19 further rotates, a yarn end in the succeeding hole 24*b* will be cut in a similar manner by the fixed blase 13 and a rear edge of the hole 24*b*. Then, if rotation of the drum 19 and the sucking action are stopped at a suitable point of time, that is, after a sufficient period of time to allow a tail yarn wound on the tail portion of a spinning bobbin to be released completely, and that is, after a preset period of time which is determined by the length of a tail yarn prescribed on a spinning machine side and by a rotational speed of the drum 19, an end of a yarn will be drawn out from the spinning bobbin and extend between the spinning bobbin 1 and a hole in the drum 19 adjacent the fixed blade 13. Then, if the spinning bobbin is moved to a succeeding yarn end handling station, since any of the holes of the drum 19 is not acted upon by a sucking force, the yarn end Y2 between the casing 5 and the drum 19 will be drawn out easily therefrom and also from the hole 12 of the casing 5 and will be moved while it depends onto a surface of a yarn layer of the spinning bobbin.

A yarn drawing out operation by the suction cutter drum 6 and the suction casing 5 will be described with reference to FIGS. 9 and 10. In particular, in case of FIG. 9, if the yarn end Y1 is sucked into the hole 24*a* of the drum 19, as the drum 19 rotates in the direction of the arrow mark R2, the yarn end Y1 is fed while caught by a rear edge of the hole 24 so that the tail yarn is forcibly drawn out from the spinning bobbin while the yarn end extending along the outer circumferential face of the drum 19 is sucked into the holes 24*b* and 24*c* succeeding the hole 24 by their sucking actions to form loops Y2*b* and Y2*c*. As a result, rear edges 24*b*1 and 24*c*1 of the holes 24*b* and 24*c*, respectively, are engaged with the yarn so that the yarn is acted upon by a force to positively move the yarn end in the direction of rotation of the drum 19. In this case, the smaller the gap S between the inner circumferential face of the suction case 5 and the outer circumferential face 15 of the drum 19, the more effective it becomes, and the gap S is effective for positively feeding a yarn when it is such that a yarn Y2*bc* is lightly nipped between the inner circumferential face 9*a* of the casing 5 and the outer circumferential face 15 of the drum 19.

Figure 9:
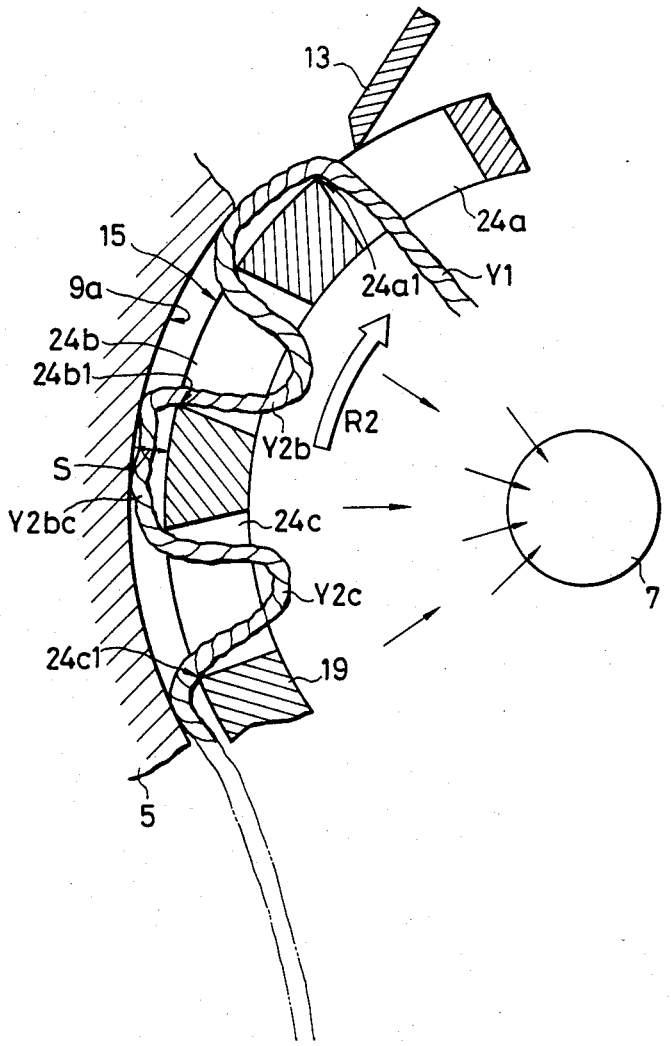
FIG. 9 is a view illustrating operations for drawing out and positively feeding an end of a yarn.
Figure 10:
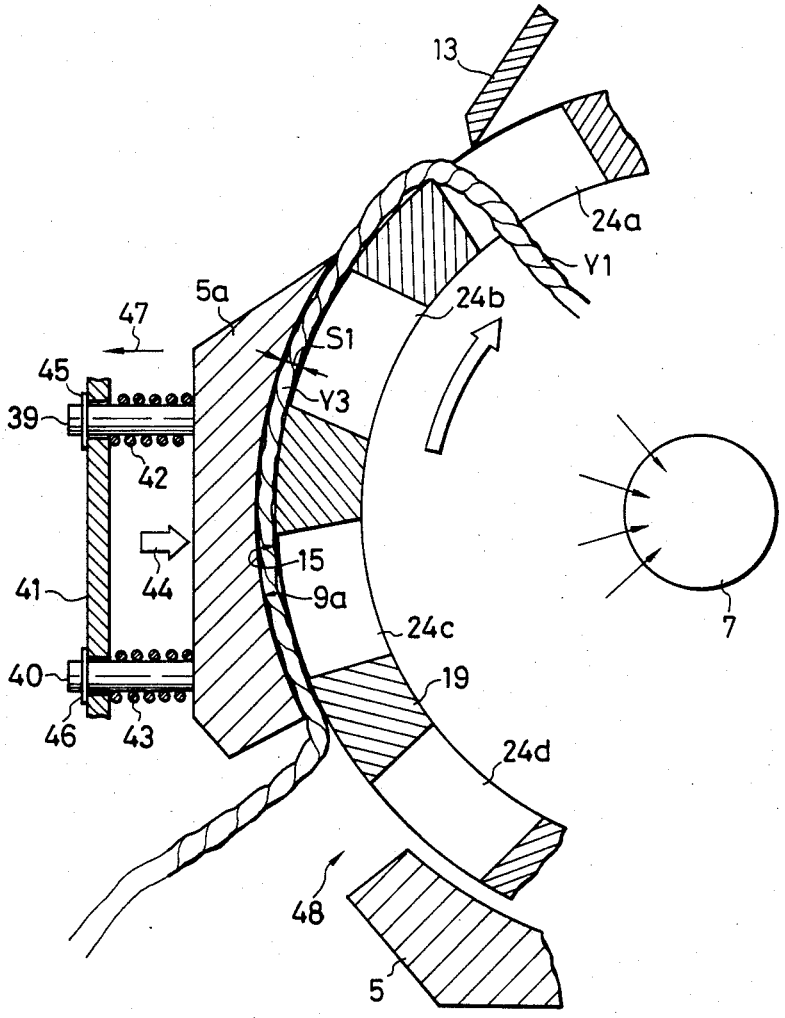
FIG. 10 is a cross sectional plan view illustrating another embodiment wherein part of a suction case is movable.

FIG. 10 illustrates a yarn which is so still that a loop may not be formed in a hole as seen in FIG. 9. In this case, a force to feed a yarn is produced by a nipping force between the inner circumferential face 9*a* of the casing 5 and the outer circumferential face 15 of the drum 19 as the drum 19 rotates, and the yarn is thus fed positively by the force. Accordingly, it might be more effective if only a yarn feeding portion 5*a* of the casing 5 is made movable and a force is exerted to press the yarn feeding portion of the casing 5 against the outer circumferential face of the drum 19. For example, a yarn feeding portion 5*a* is separated from the other portion of the casing 5 and a pair of slide rods 39 and 40 are fixedly mounted on the yarn feeding portion 5*a* of the casing 5 while the slide rods 39 and 40 slidably extend through a fixed plate 41 and compression springs 42 and 43 are interposed between the fixed plate 41 and the yarn feeding portion 5*a* of the casing 5 for urging the yarn feeding portion 5*a* in a direction of an arrow mark 44 to move the inner circumferential face 9*a* of the yarn feeding portion 5*a* toward the outer circumferential face 15 of the drum 19. The gap S1 between the inner circumferential face 9*a* of the yarn feeding portion 5*a* and the outer circumferential face 15 of the drum 19 is adjustable by mounting positions of stop members 45 and 46 and is determined in accordance with the thickness of a yarn Y3 which is to pass therethrough such that the yarn Y3 may be pressed against the outer circumferential face 15 of the drum 19. In other words, a dimension of the gap S1 at least smaller than the thickness of the yarn may be selected. It is to be noted that the yarn feeding portion of the casing may be moved, for example, by a solenoid, cylinder, or a similar device in place of the urging force of the spring.

Further, if the yarn feeding portion 5*a* of the casing 5 is made movable so that it may be moved in a direction to expand the gap S1, that is, in a direction of an arrow mark 47 in FIG. 10 against the forces of the springs 42 and 43 when a spinning bobbin is to be fed to a subsequent next step after completion of a yarn end drawing out operation of the spinning bobbin, a resisting force will not act upon a yarn on the drum 19 and hence a yarn between an opening 48 and the fixed blade 13 can be drawn out easily through the opening as the spinning bobbin moves, thus preventing excessive releasing of the yarn from the spinning frame is prevented. Movement of the yarn feeding portion 5*a* of the casing 5 in the direction of the arrow mark 47 may be attained, for example, by a cam or the like so that a spinning bobbin may be moved by movement of an operating member for feeding a spinning bobbin to a subsequent next step.

While description of the embodiments is given hereinabove in connection with a case wherein a tail yarn coils itself around a lower end portion of a spinning bobbin, it is naturally possible to apply the yarn end finding device 3 for a spinning bobbin which has what is called a top bunch wound around a head portion thereof.

As apparent from the foregoing description, according to the present invention, a yarn end finding device comprises a suction case, a suction cutter drum in the form of a drum mounted for rotation along a cylindrical inner face of the suction case and having a number of yarn end sucking holes formed in an outer circumferential face thereof, an end of a yarn of a spinning bobbin which is sucked through a yarn end passing hole formed in the suction case and through one of the holes of the suction cutter drum being fed through a gap formed between the outer circumferential face of the suction cutter drum and the inner circumferential face of the suction case, and a fixed blade mounted in contact with the outer circumferential face of the suction cutter drum for cooperating with the one of the holes of the suction cutter drum to cut an end of a yarn fed through the gap. Accordingly, an end of a yarn which has been once sucked into the interior of the suction cutter drum is fed forcibly as the suction cutter drum rotates. As a result, a yarn end coiling itself at random around a spinning bobbin, a yarn end which is entangled with a winding beginning end of a yarn of a spinning bobbin or which is admitted in a metal fixture portion of a spinning bobbin, or the like, can be forcibly drawn out, and hence the yarn end finding device can effect finding of a yarn end very certainly as a spinning bobbin yarn end finding device. Thus, particularly releasing and drawing out of an end of a yarn which is caught by a metal fixture portion at an end of a spinning bobbin or drawing out of a twined yarn or the like can be effected easily which has been impossible on a conventional yarn end finding device wherein air is blown in an axial direction of a spinning frame to an end of a yarn to draw out the yarn end.

What is claimed is:

1. A yarn end finding device for a spinning bobbin comprising:

a partition located adjacent a spinning bobbin, said partition having an aperture therethrough;

suction means located on a side of said partition for drawing a yarn end of said spinning bobbin located on an opposite side of said partition through said aperture in said partition;

a rotary member having a periphery and disposed on the same side of said partition as said suction means;

means for rotating said rotary member;

grasping means located on said rotary member for grasping said drawn yarn end to draw the yarn end into contact with the rotary member and cause the yarn end to be wrapped around the periphery of the rotary member as said rotary member rotates; and cutter means located adjacent said rotary member for cutting said drawn yarn end as said rotary member rotates.

2. A yarn end finding device as claimed in claim 1, wherein said rotary member comprises a drum.

3. A yarn end finding device as claimed in claim 1, wherein said partition and said rotary mexber are formed in spaced relationship.

4. A yarn end finding device as claimed in claim: 1, wherein said partition includes a second aperture through which said cutter means extends.

5. A yarn end finding device as claimed in claim 4, further comprising:

a screw, wherein said blade is secured to said partition by said screw.

6. A yarn end finding device as claimed in claim 5, wherein said blade has a width greater than the maximum diameter of the aperture in said drum.

7. A yarn end finding device as claimed in claim 3, further comprising:

adjustment means for adjusting the distance between said rotary member and said partition.

8. A yarn end finding device as claimed in claim 3, further comprising:

adjusting means for adjusting the distance between at least a portion of said partition and said rotary member.

9. A yarn end finding device as claimed in claim 8, wherein said adjustment means comprises:

a fixed plate; and a pair of rods slidably extending through said fixed plate, said rods being mounted to said at least one portion of said partition.

10. A yarn end finding device according to claim 2, wherein said grasping means conprises:

a portion of said drum having an aperture therethrough.

11. A yarn end finding device according to claim 10, wherein said cutter means comprises:

a blade adjacent which said portion of said drum having said aperture rotates.

12. A yarn end finding device for a bobbin, comprising:

a barrier having an aperture therethrough;

suction means on one side of said barrier for drawing a yarn end of a bobbin located on another side of said barrier through said aperture;

a rotary member on the same side of said barrier as said suction means, said rotary member receiving the drawn yarn end and having a periphery about which said yarn end is wrapped as said rotary member rotates; and cutting means adjacent said rotary member for cutting said yarn end as said rotary member rotates.

13. A yarn end finding device for a bobbin, comprising:

a barrier;

a contoured member located on one side of said barrier, said contoured member having a periphery;

drawing means for drawing a yarn end of said bobbin between said contoured member and said barrier and into engagement with the periphery of the contoured member;

advancement means for increasing the length of said yarn end in engagement with said periphery of said contoured member, thereby increasing the length of said yarn end disposed between said contoured member and said barrier; and cutting means for cutting said yarn end when a predetermined length of yarn is disposed between said contoured member and said barrier.

* * * * *